United States Patent [19]

Hoke, Jr.

[11] Patent Number: 4,799,537

[45] Date of Patent: Jan. 24, 1989

[54] SELF REGULATING HEAT PIPE

[75] Inventor: Bryan C. Hoke, Jr., Lancaster, Pa.

[73] Assignee: Thermacore, Inc., Lancaster, Pa.

[21] Appl. No.: 108,279

[22] Filed: Oct. 13, 1987

[51] Int. Cl.[4] ..... F28D 15/02

[52] U.S. Cl. ..... 165/32; 165/104.27

[58] Field of Search ..... 165/32, 104.27

[56] References Cited

U.S. PATENT DOCUMENTS

| | | | |
|---|---|---|---|
| 2,961,476 | 11/1960 | Maslin et al. | 165/104.27 |
| 3,517,730 | 6/1970 | Wyatt . | |
| 3,543,841 | 12/1970 | Eastman . | |
| 3,563,309 | 2/1971 | Basiulis . | |
| 3,613,773 | 10/1971 | Hall . | |
| 3,782,449 | 1/1974 | Busse . | |
| 3,958,627 | 5/1976 | Edelstein . | |
| 4,286,652 | 9/1981 | Busse . | |
| 4,300,626 | 11/1981 | Busse . | |
| 4,403,651 | 9/1983 | Groke . | |
| 4,413,671 | 11/1983 | Basiulis . | |

FOREIGN PATENT DOCUMENTS

| | | | |
|---|---|---|---|
| 2149493 | 6/1985 | United Kingdom | 165/32 |

OTHER PUBLICATIONS

Marcus, B. D., *Heat Pipes: Control Techniques,* Report 2, NASA Contract No. NAS2-5503, 7/1971.

Bienert, W., *Heat Pipes for Temperature Control,* Proceedings of the Fourth Intersociety Energy Conversion Conference, Wash., DC, 9/1969, pp. 1033-1041.

Chi, S. W., *Heat Pipe Theory and Practice,* McGraw-Hill Book Co., NY, 1976, pp. 8-11.

*Primary Examiner*—Albert W. Davis, Jr.

*Attorney, Agent, or Firm*—Martin Fruitman

[57] ABSTRACT

A structure for more accurately automatically controlling the heat transfer characteristics of a heat pipe with a non-condensible gas. The gas, intermixed with the heat transfer vapor, is largely contained by an expanding and contracting bladder. This permits the vapor pressure of the heat transfer fluid to control the position of the non-condensible gas to vapor front with less back pressure from the gas which is being compressed. The bladder is contained within a structure which is itself enclosed within the interior of the heat pipe evaporator so that the non-condensible gas is held at a constant temperature.

4 Claims, 1 Drawing Sheet

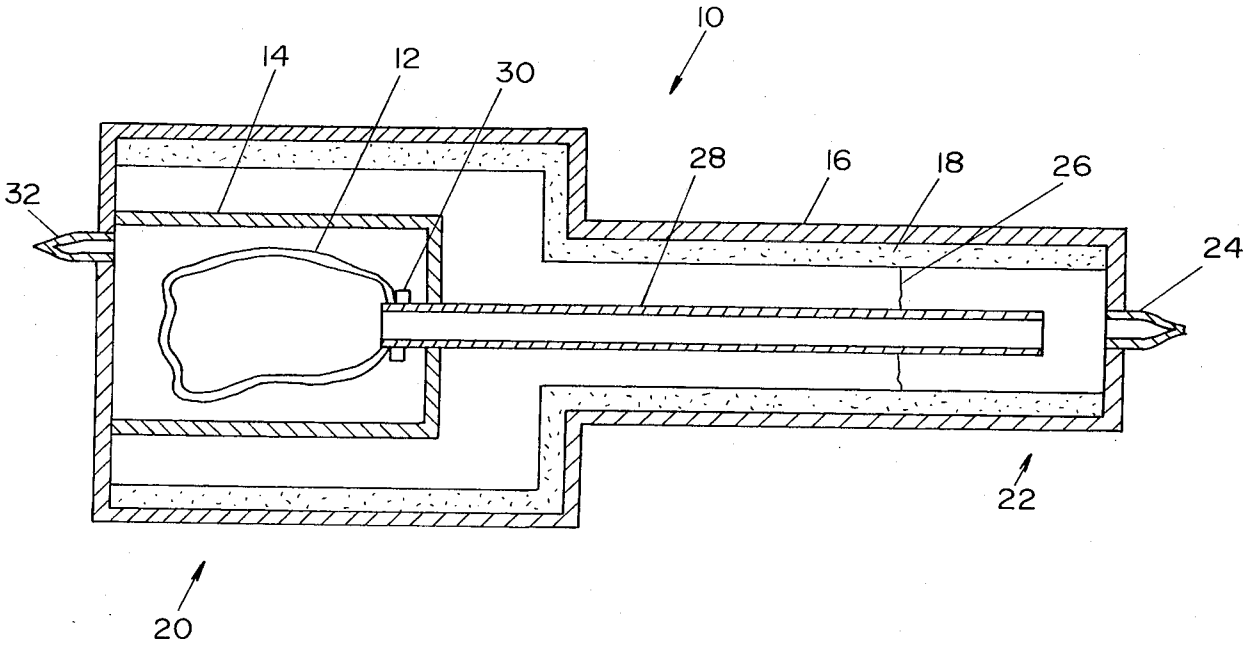
10
12
14
16
18
20
22
24
26
28
30
32

SELF REGULATING HEAT PIPE

The United States Government has rights to this invention pursuant to Contract No. N00164-87-C-0024 between the U.S. Navy and Thermacore, Inc.

SUMMARY OF THE INVENTION

This invention deals generally with heat pipes and more specifically with the temperature control of heat pipes by the use of a non-condensible gas reservoir.

The use of non-condensible gas as a means of regulating the heat transfer characteristics of a heat pipe is well established. In most such arrangements the gas is accessible to the vapor space of the heat pipe from a separate reservoir and its pressure or volume is controlled by some simple means such as changing its temperature or changing the volume of the reservoir, such as by a bellows. In U.S. Pat. No. 3,517,730 by T. Wyatt it was also shown that the bellows action could be controlled by an independent mechanical thermocouple device so that a feedback system was created which automatically controlled the heat pipe temperature. Such mechanical devices add complexity and size to the installation and can adversely affect reliability.

Another problem in the use of the non-condensible gas is that there is always a significant amount of working fluid vapor mixed with the non-condensible gas. This can lead to problems of condensation of the vapor within the non-condensible gas reservoir if the temperature of the reservoir is low enough and this causes erratic temperature control. Wyatt attacks this problem by adding an electrical heater and an insulated container around the non-condensible gas reservoir, again adding complexity and size to the configuration.

The present invention presents a self-regulating heat pipe which uses a non-condensible gas within a novel structure. It uses an expandable reservoir which is located within the evaporator region of the heat pipe itself but is connected with and affected by the condenser region through a pipe or tubing which extends from the reservoir back to the condenser region.

The result is that the expandable gas reservoir is operated at a virtually constant temperature, that of the heat pipe evaporator, which is always too high to permit condensation of the working fluid vapor. Moreover, the resistance to the expansion of the reservoir is essentially constant because the gas in the secondary reservoir which resists the expansion is also held at the same constant temperature so that its pressure essentially does not increase.

The preferred embodiment of the invention uses an expandable reservoir in the form of a balloon or bladder with very low resistance to expansion. The bladder is constructed of aluminized mylar, so that it is usable in a relatively low temperature heat pipe using water as a working fluid. In such an arrangement, the gas pressure to which the secondary reservoir is filled is the only resistance to expansion of the primary reservoir, and the primary non-condensible gas reservoir will increase or decrease its volume from only the action of the pressure of the working fluid vapor. Thus, no outside thermostatic control is required, and the result is a highly stable self regulating, temperature controlled heat pipe.

BRIEF DESCRIPTION OF THE DRAWINGS

The FIGURE is a simplified cross section view of a heat pipe of the preferred embodiment.

DETAILED DESCRIPTION OF THE INVENTION

The FIGURE is a simplified cross section view along the axis of the preferred embodiment of the invention in which heat pipe 10 encloses non-condensible gas primary reservoir 12 and secondary reservoir 14.

Heat pipe 10 is conventionally constructed of sealed casing 16 with capillary wick 18 lining the inner walls of casing 16. In operation, one end of heat pipe 10 is the evaporator region 20 to which heat is applied and the other end is the condenser region 22 from which heat is removed. If heat pipe 10 were evacuated and only vaporizable working fluid were loaded into it at fill tube 24, it would operate as a conventional heat pipe.

However, when a non-condensible gas such as nitrogen is also loaded into heat pipe 10, it operates somewhat differently. As is well understood in the art, the non-condensible gas will be swept to condenser region 22 of the heat pipe 10 by the movement of the working fluid vapor and the gas will collect there, preventing that part of the heat pipe which it occupies from operating as a heat pipe. In fact, a boundary 26 will form between the volume of the heat pipe which contains non-condensible gas and that volume which does not.

The present invention adds to this conventional configuration in order to attain self regulating temperature control for the heat pipe.

The additional structure is essentially three items. Secondary reservoir 14, which has a non-expandable structure is located in evaporator region 20. It encloses primary reservoir 12 the opening of which is attached to conduit 28 and held in place by clamp 30. The end of conduit 28 which is remote from primary reservoir 14 opens into the interior of heat pipe 10 near the end of condenser region 22 which is most remote from evaporator region 20. The open end of conduit 28 is located well into the region of the heat pipe which contains the non-condensible gas.

During normal operation the non-condensible gas will, therefore, fill conduit 28 and partially inflate expandable primary reservoir 12. This expansion will be resisted and limited by the pressure of the non-condensible gas which has been loaded into secondary reservoir 14 through its fill tube 32.

The pressure of the gas in secondary reservoir 14 determines the heat pipe's temperature control point, and that pressure is one of the design parameters. The pressure of the gas in secondary reservoir 14 should be the same as the vapor pressure of the heat transfer fluid in the heat pipe at the nominal operating temperature.

With the pressure of the gas in secondary reservoir 14 determined, pressure equilibrium will be established between secondary reservoir 14 and the gas and vapor mixture in expandable primary reservoir 12, and boundary 26 will locate where it forces the working fluid vapor pressure and the pressure of the mixture of vapor and non-condensible gas to also be equal.

The automatic control phenomenon will then function as follows.

If conditions attempt to raise the temperature of evaporator region 20, the vapor pressure of the heat transfer fluid will attempt to rise. This will push boundary 26 farther away from evaporator region 20 and thereby activate more surface of heat pipe 10 within condenser region 22 to afford more cooling to limit the temperature rise at evaporator 20.

The movement of boundary 26 meets only slight resistance because it is accommodated to by the expansion of primary reservoir 12, which is, in effect, at the opposite end of the combined gas vapor zone from boundary 26. The expansion of primary reservoir 12 itself meets with little resistance because its movement is resisted only by the gas pressure in secondary reservoir 14, which is,as mentioned, nominally the same as the vapor pressure of the heat transfer fluid. The increased volume of primary reservoir 12 therefore limits the temperature increase of evaporator region 20, and a decrease in volume of primary reservoir 12 will also occur to limit a decrease in temperature of evaporator region 20.

This feedback system is aided by the fact that the non-condensible gases in secondary reservoir 14 and in primary reservoir 12 are essentially at the temperature of evaporator region 20 and are therefore at a constant temperature, thus eliminating any temperature change effects on pressure.

Moreover, since the temperature of the gases is approximately that of the highest temperature in the system, no condensation of vapor will occur in expandable primary reservoir 12.

The present invention has been tested in a heat pipe constructed of copper, with water as the working fluid, and having an expandable primary reservoir constructed of aluminized mylar. This embodiment showed superior self regulating properties in that, with a change in heat sink temperature over the range from negative 0.23 degrees C. to positive 29.4 degrees C., the heat pipe evaporator temperature varied only 1.15 degrees C. from the set point temperature of 36.1 degrees C. On the other hand a more conventional heat pipe with a fixed wall non-condensible gas reservoir could be expected to have a variation in evaporator temperature approximately four times as great.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, expandable primary reservoir 12 could be constructed as a bellows or a piston rather than as a balloon or bladder. Moreover, another means of resisting the expansion of the primary reservoir could be used. A spring could, for instance, be used in conjunction with a piston to permit the expandable primary reservoir to react to increased vapor pressure.

What is claimed as new and for which Letters Patent of the United States are desired to be secured is:

1. A heat pipe comprising:

a sealed hollow casing;

a quantity of vaporizable heat transfer fluid within the casing;

a quantity of non-condensible gas within the casing;

an expandable primary reservoir volume with an opening, the primary reservoir being located within the casing in a evaporator region of the casing to which heat is applied and acted upon by a force means which resists the expansion of the primary reservoir volume, wherein the force means is a secondary reservoir filled with a non-condensible gas, with the primary reservoir volume enclosed within the secondary reservoir; and conduit means with one end attached to the opening of the primary reservoir, and the other end opening into a condenser region of the heat pipe from which heat is removed.

2. The heat pipe of claim 1 further including a capillary wick structure attached to the inside of the casing.

3. The heat pipe of claim 1 wherein the primary reservoir volume is an expandable bladder.

4. The heat pipe of claim 3 wherein the expandable bladder is constructed of aluminized mylar.

* * * * *